US008644722B2

(12) United States Patent
Yoda et al.

(10) Patent No.: US 8,644,722 B2
(45) Date of Patent: Feb. 4, 2014

(54) FIXING DEVICE AND IMAGE FORMING APPARATUS WITH THE SAME

(75) Inventors: Junya Yoda, Osaka (JP); Satoshi Takahashi, Osaka (JP); Fumiaki Takiguchi, Osaka (JP)

(73) Assignee: Kyocera Mita Corporation (JP)

( * ) Notice: Subject to any disclaimer, the term of this patent is extended or adjusted under 35 U.S.C. 154(b) by 278 days.

(21) Appl. No.: 13/283,682

(22) Filed: Oct. 28, 2011

(65) Prior Publication Data

US 2012/0107006 A1 May 3, 2012

(30) Foreign Application Priority Data

Oct. 29, 2010 (JP) ..... 2010-244541
Sep. 28, 2011 (JP) ..... 2011-212203

(51) Int. Cl.
*G03G 15/20* (2006.01)

(52) U.S. Cl.
USPC ..... 399/70

(58) Field of Classification Search
USPC ..... 399/33, 67–70, 320, 328; 219/216, 619
See application file for complete search history.

(56) References Cited

U.S. PATENT DOCUMENTS

| | | | | |
|---|---|---|---|---|
| 6,321,046 | B1 | 11/2001 | Kikuchi et al. | |
| 6,544,708 | B2 * | 4/2003 | Komoto et al. | 430/124.32 |
| 7,747,195 | B2 * | 6/2010 | Yoshino et al. | 399/122 |
| 2006/0201937 | A1 | 9/2006 | Suenaga et al. | |

FOREIGN PATENT DOCUMENTS

| | | |
|---|---|---|
| JP | 2003-202772 | 7/2003 |
| JP | 2004-327124 | 11/2004 |
| JP | 2005-257898 | 9/2005 |

* cited by examiner

*Primary Examiner* — Hoan Tran
(74) *Attorney, Agent, or Firm* — Gerald E. Hespos; Michael J. Porco; Matthew T. Hespos

(57) ABSTRACT

A fixing device is provided with a fixing unit for fixing a toner image; a magnetic flux generator including a switching element for generating a magnetic flux; and a control unit for performing a start-up mode for raising the temperature of the fixing unit to a fixing temperature by the magnetic flux and a steady mode for maintaining the temperature of the fixing unit at the fixing temperature. The control unit turns off the switching element when the temperature of the switching element is equal to or higher than a first reference temperature lower than a destruction temperature during a period of the start-up mode, and turns off the switching element when the temperature of the switching element is equal to or higher than a second reference temperature lower than the destruction temperature and higher than the first reference temperature during a period of the steady mode.

7 Claims, 8 Drawing Sheets

FIXING DEVICE AND IMAGE FORMING APPARATUS WITH THE SAME

BACKGROUND OF THE INVENTION

1. Field of the Invention

The present disclosure relates to a fixing device and an image forming apparatus.

2. Description of the Related Art

The image forming apparatus includes a fixing device for heating a recording sheet having a toner image transferred thereon and fixing the toner image to the recording sheet.

The above device causes a fixing roller to generate heat by switching on and off a switching element to change the magnitude and direction of a magnetic flux generated by an induction coil.

Self-heat generation occurs when the switching element is turned on and off. The switching element is destroyed if the temperature thereof reaches a destruction temperature (absolute maximum rating), which is a temperature at which the switching element is destroyed, due to such self-heat generation.

Accordingly, to prevent the temperature of the switching element from reaching the destruction temperature, a temperature sensor for detecting the temperature of the switching element is arranged and this image forming apparatus stops the on/off switching of the switching element when the temperature of the switching element detected by the temperature sensor reaches a predetermined temperature. This prevents the temperature of the switching element from reaching the destruction temperature to destroy the switching element.

The temperature of the switching element detected by the temperature sensor is thermally conducted from the switching element to the temperature sensor. Thus, there is a difference between the temperature detected by the temperature sensor and the temperature of the switching element. Further, such a temperature difference also changes depending on an operating condition of the image forming apparatus.

Thus, if the on/off switching of the switching element is stopped when the temperature detected by the temperature sensor reaches the predetermined temperature as described above, the stop of the on/off switching of the switching element may be late for a temperature change of the switching element. Therefore, it has been difficult to reliably protect the switching element from destruction caused by heating.

SUMMARY OF THE INVENTION

The present disclosure is made to solve the above problem and aims to provide a fixing device capable of improving reliability in protecting a switching element from overheating and an image forming apparatus including this fixing device.

One aspect of the present disclosure is directed to a fixing device, including a fixing unit for fixing a toner image to a recording sheet by heat; a magnetic flux generator including a switching element for switching a current for generating a magnetic flux to cause heat generation of the fixing unit and adapted to generate a magnetic flux for causing heat generation of the fixing unit; a temperature detector for detecting the temperature of the switching element; and a control unit for performing a start-up mode for raising the temperature of the fixing unit to a fixing temperature suitable for fixing the toner image to the recording sheet by starting heat generation of the fixing unit by the magnetic flux generated by the magnetic flux generator and a steady mode for controlling heat generation of the fixing unit so that the temperature of the fixing unit is maintained at the fixing temperature after the temperature of the fixing unit reaches the fixing temperature, wherein the control unit turns off the switching element when the temperature of the switching element detected by the temperature detector is equal to or higher than a first reference temperature lower than a destruction temperature at which the switching element may be destroyed during a period of the start-up mode, and turns off the switching element when the temperature of the switching element detected by the temperature detector is equal to or higher than a second reference temperature lower than the destruction temperature and higher than the first reference temperature during a period of the steady mode.

Another aspect of the present disclosure is directed to an image forming apparatus, including the above fixing device; an image data acquirer for acquiring image data; and an image forming unit for fixing a toner image representing image data acquired by the image data acquirer to a recording sheet by the fixing device.

These and other objects, features and advantages of the present invention will become more apparent upon reading the following detailed description along with the accompanying drawings.

DETAILED DESCRIPTION OF THE PREFERRED EMBODIMENTS

Figure 1:
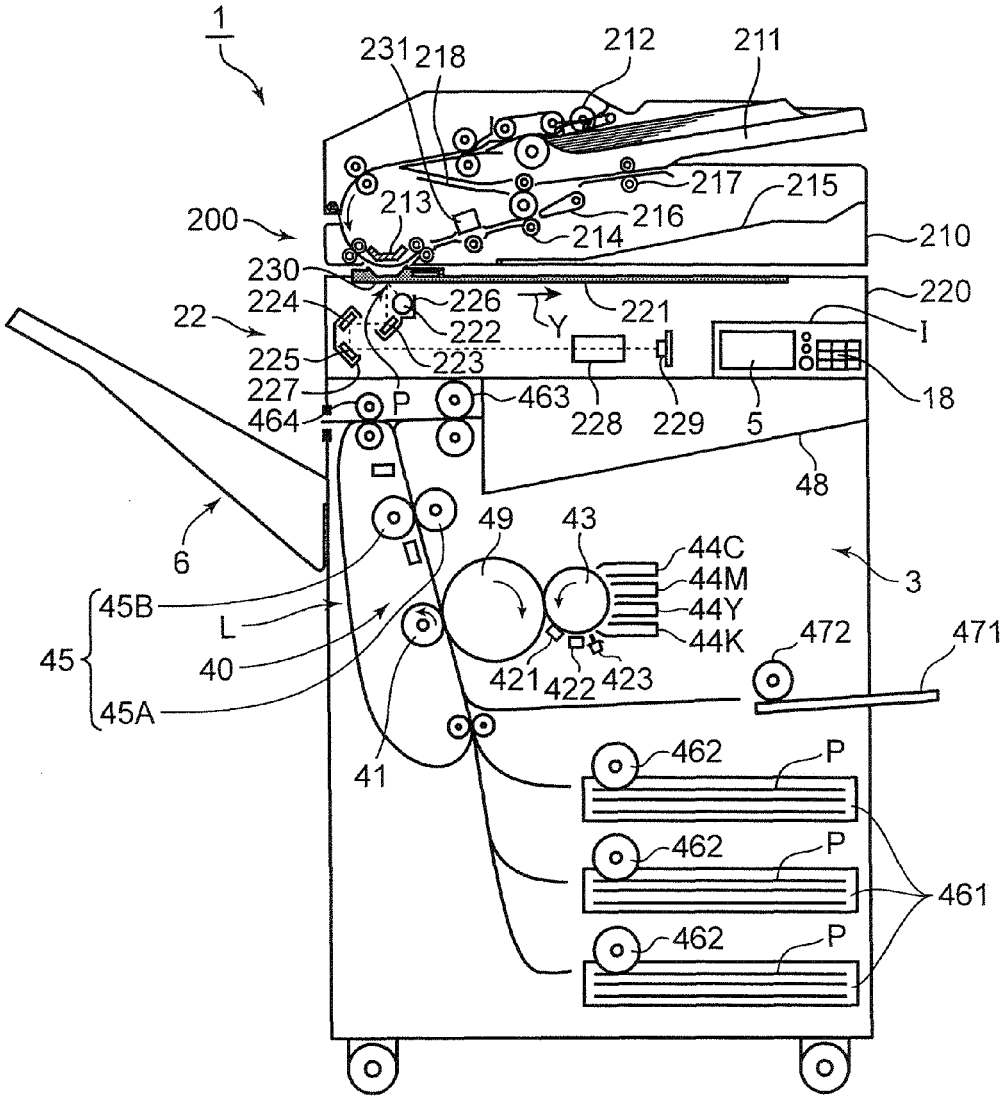
FIG. 1 is a schematic sectional view of an image forming apparatus according to one embodiment of the present disclosure.

Hereinafter, an embodiment of the present disclosure is described with reference to the drawings. FIG. 1 is a schematic sectional view of an image forming apparatus according to one embodiment of the present disclosure. Note that the image forming apparatus 1 includes a built-in fixing device to be described later.

The image forming apparatus 1 includes an image reader 200 (an example of an image data acquirer) and an image forming main unit 22. The image reader 200 includes a document feeder 210, a scanner unit 220, a CIS (Contact Image Sensor) 231, a user interface unit I arranged to be exposed on the front surface of the image forming main unit 22 and a reversing mechanism to be described later.

The document feeder 210 constitutes an ADF (Automatic Document Feeder) and includes a document tray 211, a pickup roller 212, a platen 213, a pair of discharge rollers 214 and a discharge tray 215. Documents to be read are placed on the document tray 211. The documents placed on the document tray 211 are fed one by one by the pickup roller 212 and successively conveyed to the platen 213 via a clearance. The documents conveyed through the platen 213 are successively discharged to the discharge tray 215 by the pair of discharge roller pair 214.

An unillustrated timing sensor for detecting a document is disposed at a predetermined position facing a peripheral surface of the platen 213 and before a reading position P in a document conveying direction. Based on an output request of this timing sensor, conveyance of a document to the reading position P is timed. The timing sensor is, for example, composed of a photo interrupter.

The scanner unit 220 generates image data by optically reading a document image. The scanner unit 220 includes a glass 221, a light source 222, a first mirror 223, a second mirror 224, a third mirror 225, a first carriage 226, a second carriage 227, an imaging lens 228 and a CCD (Charge Coupled Device) 229.

This scanner unit 220 includes a white fluorescent lamp as the light source 222. Further, the scanner unit 220 introduces light from a document to the CCD 229 via the first mirror 223, the second mirror 224, the third mirror 225 and the imaging lens 228. Since using the white fluorescent lamp as the light source 222, the scanner unit 220 has better color reproducibility than the CIS 231 to be described later using three color LEDs or the like as a light source.

A document is manually placed on the glass 221 by a user at the time of document reading without using the document feeder 210. The light source 222 and the first mirror 223 are supported by the first carriage 226 and the second mirror 224 and the third mirror 225 are supported by the second carriage 227.

As a document reading method of the image reader 200, there are a flat bed reading mode in which a document placed on the contact glass 221 is read by the scanner unit 220 and an ADF reading mode for feeding a document by the document feeder 210 (ADF) and reading it during the conveyance thereof.

In the flat bed reading mode, the light source 222 irradiates a document placed on the glass 221 with light, and reflected light of one line in a main scanning direction is successively reflected by the first mirror 223, the second mirror 224 and the third mirror 225 to be incident on the imaging lens 228. The light incident on the imaging lens 228 is imaged on a light receiving surface of the CCD 229.

The CCD 229 is a linear image sensor and processes one line of document image data in an overlapping manner. The first carriage 226 and the second carriage 227 are formed to be movable in a direction (sub scanning direction, direction of an arrow Y) perpendicular to the main scanning direction. When reading of one line is completed, the first and second carriages 226, 227 move in the sub scanning direction to read the next line.

In the ADF reading mode, the document feeder 210 feeds documents placed on the document tray 211 one by one using the feed roller 212. At this time, the first and second carriages 226, 227 are positioned at the predetermined reading position P located below a reading window 230.

When a document passes above the reading window 230 provided to face the platen 213 during conveyance by the document feeder 210, the light source 222 irradiates the document with light and reflected light of one line in the main scanning direction is successively reflected by the first mirror 223, the second mirror 224 and the third mirror 225 to be incident on the imaging lens 228. The light incident on the imaging lens 228 is imaged on the light receiving surface of the CCD 229. Subsequently, the document is conveyed by the document feeder 210 for reading of the next line.

The document feeder 210 further includes the reversing mechanism with a switching guide 216, a pair of reversing rollers 217 and a reversing conveyance path 218. This reversing mechanism reverses a document having one side read by the first ADF reading and re-conveys it toward the reading window 230, whereby the other side of the document is read by the CCD 229.

This reversing mechanism operates only during both-side reading, but does not operate during one-side reading. During one-side reading and after reading of the other side during both-side reading, the switching guide 216 is switched to an upper side and the document having passed through the platen 213 is discharged to the discharge tray 215 by the pair of discharge rollers 214.

After reading of one side during both-side reading, the switching guide 216 is switched to a lower side and the document having passed through the platen 213 is conveyed to the reversing conveyance path 218 by the pair of reversing rollers 217. Thereafter, the switching guide 216 is switched to the upper side and the pair of reversing rollers 217 are rotated in reverse directions to feed the document again to the platen 213. Hereinafter, a mode of reading both sides of a document using the reversing mechanism is referred to as a both-side reversing/reading mode.

Further, in the ADF reading mode, the image reader 200 can cause the CIS 231 to read the other side of a document substantially simultaneously with (substantially in parallel with) reading of one side of the document by the CCD 229 (scanner unit 220) during the conveyance of the document as described above. In this case, the document conveyed from the document tray 211 to the platen 213 has the one side read by the CCD 229 when passing above the reading window 230 and further has the other side read when passing the arrangement position of the CIS 231. Note that three RGB LEDs or the like are used as a light source in the CIS 231.

By using the CCD 229 and the CIS 231 in this way, both sides of a document can be read by one document conveyance (one-pass operation) from the document tray 211 to the discharge tray 215 by the document feeder 210. Hereinafter, a mode of reading both sides of a document using the CCD 229 and the CIS 231 in this way is referred to as a both-side simultaneous reading mode.

The both-side reversing/reading mode and the both-side simultaneous reading mode are provided as reading modes in reading both sides of a document using the ADF reading mode. The both-side reversing/reading mode is used when it is desired to have the same image quality of printed images on both sides, whereas the both-side simultaneous reading mode is used when it is desired to preferentially shorten a reading time even if there is a difference in image quality of printed images on both sides. The image forming apparatus 1 is, for example, initialized to the both-side simultaneous reading mode and a document image reading operation is performed in the both-side simultaneous reading mode when an instruction to form an image is input without any mode setting operation being performed for the reading mode.

The image forming apparatus 1 includes the image forming main unit 22 and a stack tray 6 arranged on the left side of the image forming main unit 22. The image forming main unit 22 includes a plurality of sheet cassettes 461, feed rollers 462 for feeding recording sheets P one by one from the sheet cassettes 461 and conveying them to an image forming unit 40, and the image forming unit 40 for forming images on recording sheets conveyed from the sheet cassettes 461. Further, the image forming main unit 22 includes a sheet feed tray 471 and a feed roller 472 for feeding documents placed on the sheet feed tray 471 one by one toward the image forming unit 40.

The image forming unit 40 includes a charge remover 421 for removing residual charges from a surface of a photoconductive drum 43, a charger 422 for charging the surface of the photoconductive drum 43 after charge removal, an exposure device 423 for exposing the surface of the photoconductive drum 43 by outputting a laser beam based on image data obtained by the scanner unit 220 and forming an electrostatic latent image on the surface of the photoconductive drum 43, developing devices 44C, 44M, 44Y and 44K for forming toner images of respective colors, i.e. cyan (C), magenta (M), yellow (Y) and black (K) on the photoconductive drum 43 based on the electrostatic latent image, a transfer drum 49 to which the toner images of the respective colors formed on the photoconductive drum 43 are transferred to be superimposed, a transfer device 41 for transferring a full color toner image on the transfer drum 49 to a recording sheet P, and a fixing unit 45 for fixing the toner image to the sheet by heating the recording sheet P having the toner image transferred thereto.

Note that toners of the respective colors of cyan, magenta, yellow and black are supplied from unillustrated toner cartridges. Further, pairs of conveyor rollers 463, 464 and the like are provided to convey the recording sheet P having passed through the image forming unit 40 to the stack tray 6 or a discharge tray 48.

In the case of forming images on both sides of a recording sheet P, the recording sheet P is nipped by the pair of conveyor rollers 463 near the discharge tray 48 after an image is formed on one side of the recording sheet P by the image forming unit 40. In this state, the pair of conveyor rollers 463 are rotated in reverse directions to switch back the recording sheet P, the recording sheet P is conveyed again to a side upstream of the image forming unit 40 along a sheet conveyance path L, and an image is formed on the other side of the recording sheet P by the image forming unit 40. Thereafter, the recording sheet P is discharged to the stack tray 6 or the discharge tray 48.

The fixing unit 45 includes a fixing roller 45A which generates heat, and a pressure roller 45B which forms a nip between the fixing roller 45A and the pressure roller 45B. The fixing unit 45 fixes a toner image transferred to a recording sheet P to the recording sheet P by heat in the nip between the fixing roller 45A and the pressure roller 45B.

The user interface unit I includes an operation unit 5 composed of a liquid crystal monitor and the like, and operation keys 18.

The user interface unit I receives an instruction to perform a copy function as an instruction to perform a print job to be described later, for example, when the copy function is selected by operating the operation keys 18 and an unillustrated start key is operated. The copy function is a function of reading a document image by the image reader 200 and forming the document image on a recording sheet P by the image forming unit 40.

The display unit 5 is arranged to display an image used to perform the function selected by operating the operation keys 18.

Figure 2:
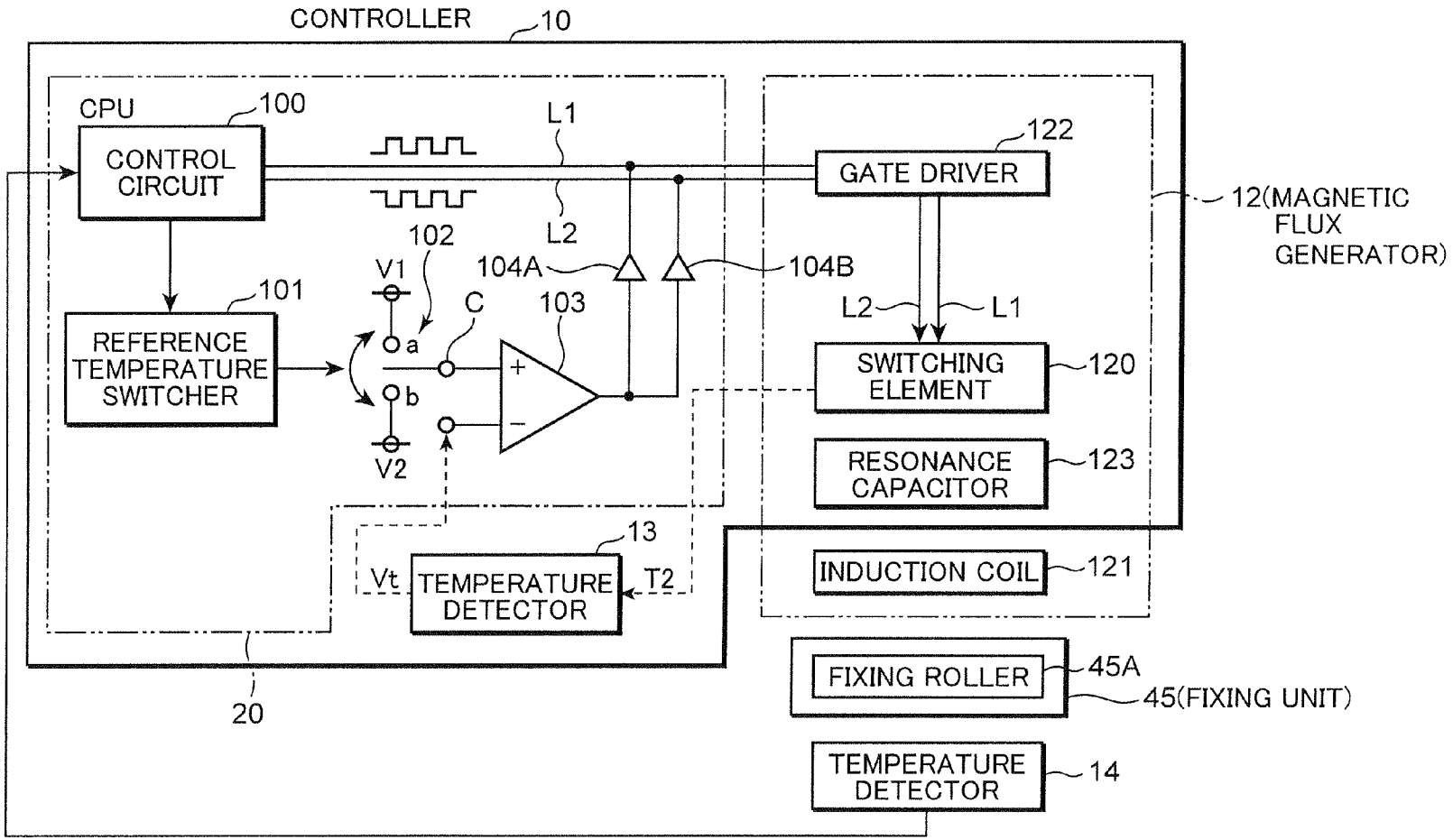
FIG. 2 is a block diagram showing an example of a function module of a fixing device built in the image forming apparatus.

FIG. 2 is a block diagram showing an example of a function module of the fixing device built-in the image forming apparatus 1.

The fixing device 2 is provided with the fixing unit 45 including at least the fixing roller 45A described above, a controller 10, an induction coil 121 and a temperature detector 14. Note that functions of the fixing unit 45 are not described since they are as described above.

Further, a magnetic flux generator 12 is formed by a part of the controller 10 and the induction coil 121. In FIG. 2, the magnetic flux generator 12 is shown by chain double-dashed line. The magnetic flux generator 12 includes a switching element 120, the induction coil 121 for generating a magnetic flux when being energized, a gate driver 122 (an example of a driver) for turning on and off the switching element 120, and a resonance capacitor 123 for changing the magnitude and direction of a magnetic flux generated by the induction coil 121.

Figure 3:
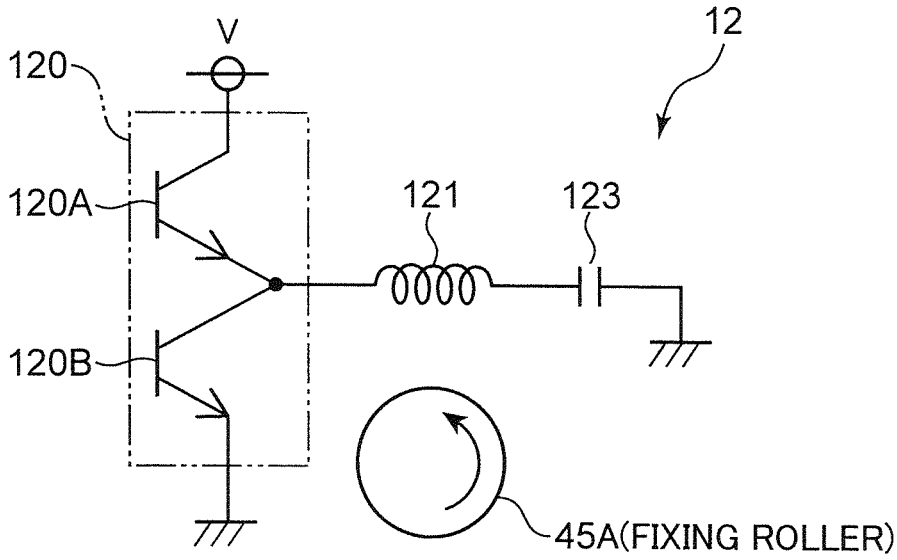
FIG. 3 is a diagram schematically showing a specific configuration example of a magnetic flux generator.

FIG. 3 is a diagram schematically showing a specific configuration example of the magnetic flux generator 12. The magnetic flux generator 12 includes switching elements 120A and 120B as the switching element 120.

A series circuit composed of the switching elements 120A, 120B is arranged between a power supply V and ground. One end of a series circuit composed of the induction coil 121 and the resonance capacitor 123 is connected to a connection point between the switching elements 120A, 120B. Further, the other end of the series circuit composed of the induction coil 121 and the resonance capacitor 123 is connected to the ground. Specifically, a collector of the switching element 120A is connected to the power supply V, an emitter of the switching element 120A is connected to a collector of the switching element 120B, and an emitter of the switching element 120B is connected to the ground. One end of the induction coil 121 is connected to a connection point between the emitter of the switching element 120A and the collector of the switching element 120B, the other end of the induction coil 121 is connected to one end of the resonance capacitor 123 and the other end of the resonance capacitor 123 is connected to the ground.

Note that various semiconductor switching elements such as bipolar transistors, MOSFETs (Metal-Oxide-Semiconductor Field-Effect Transistors) and IGBTs (Insulated Gate bipolar Transistors) can be used as the switching elements 120A, 120B.

In the thus constructed magnetic flux generator 12, a current flows from the power supply V to the ground via the switching element 120A, the induction coil 121 and the resonance capacitor 123 when the switching element 120A is on and the switching element 120B is off. In this case, the current flows through the induction coil 121 to the right in the plane of FIG. 3 and electric charges are accumulated in the resonance capacitor 123 by this current.

On the other hand, the resonance capacitor 123 is discharged when the switching element 120A is off and the switching element 120B is on. A discharge current of the resonance capacitor 123 flows into the ground via the induction coil 121 and the switching element 120B. In this case, the current flows through the induction coil 121 to the left in the plane of FIG. 3.

The temperature detector 14 detects the temperature of the fixing roller 45A (the fixing unit 45) and outputs a voltage signal indicating this temperature by a voltage to the controller 10. Such a temperature detector 14 is formed using a heat sensitive element such as a thermistor or a thermocouple. Note that a temperature detector 13 to be described later is also formed using a heat sensitive element such as a thermistor or a thermocouple similar to the temperature detector 14.

The controller 10 includes a CPU (Central Processing Unit), a ROM (Read Only Memory), a RAM (Random Access Memory) and the like and centrally controls the fixing device 2. The controller 10 includes a control unit 20, the temperature detector 13, the gate driver 122, the switching element 120 and the resonance capacitor 123. The control unit 20 includes a control circuit 100, a reference temperature switcher 101, a switch 102, a comparator 103 and buffers 104A, 104B.

The temperature detector 13 detects the temperatures of the respective switching elements 120A, 120B and outputs voltages Vta, Vtb indicating the detected temperatures to the controller 10. For example, the temperature detector 13 is a block including two heat sensitive elements, and the respective heat sensitive elements are, for example, arranged on the package surfaces of the switching elements 120A, 120B. It is assumed below that the temperature of the switching element 120A detected by the temperature detector 13 is a detected temperature T2A, the temperature of the switching element 120*b* detected by the temperature detector 13 is detected temperature T2B, a voltage indicating the detected temperature T2A is Vta and a voltage indicating the detected temperature T2B is Vtb. Further, the detected temperatures T2A, T2B are collectively referred to as detected temperatures T2 and the voltages Vta and Vtb are collectively referred to as voltages Vt.

The control circuit 100 includes, for example, the CPU, the ROM and the RAM, and on-off controls the switching elements 120A, 120B. Note that functions of the control circuit 100 are described later.

The reference temperature switcher 101 is a drive circuit for outputting a drive current to drive the switch 102. This reference temperature switcher 101 connects a contact C of the switch 102 to a contact a when a switching signal instructing connection of the contact C of the switch 102 to the contact a is output from the control circuit 100.

On the other hand, the reference temperature switcher 101 connects the contact C of the switch 102 to a contact b when a switching signal instructing connection of the contact C of the switch 102 to the contact b is output from the control circuit 100.

The switch 102 includes the contacts a, b, and C. The switch 102 is a changeover switch capable of switching between a first state where the contacts C and a are in a conductive state (connected) and a second state where the contacts C and b are in a conductive state conductive (connected). A reference voltage V1 (a first reference voltage), which is a voltage indicating a first reference temperature TS1, is supplied to the contact a, for example, from an unillustrated constant-voltage circuit. A reference voltage V2 (a second reference voltage), which is a voltage indicating a second reference temperature TS2, is supplied to the contact b, for example, from the unillustrated constant-voltage circuit. As the reference voltages V1, V2 and the voltages Vt increase, they indicate higher temperatures.

Since it takes time to transfer heat generated by self-generation of the switching elements 120A, 120B to the temperature detector 13, there are differences between actual temperatures of the switching elements 120A, 120B and the detected temperatures T2A, T2B when a start-up mode for raising the temperature of the fixing unit 45 (fixing roller 45A) in a low-temperature state below a fixing temperature up to the fixing temperature is performed.

Hereinafter, the actual temperatures of the switching elements 120A, 120B are respectively referred to as actual temperatures T1A, T1B and the actual temperatures T1A, T1B are collectively referred to actual temperatures T1.

The first reference temperature TS1 is, for example, obtained as follows and set beforehand. That is, a maximum value Tup of temperature differences between the actual temperatures T1 and the detected temperatures T2 caused by sudden temperature increases resulting from heat generation of the switching elements 120A, 120B during the execution of the normal start-up mode of the image forming apparatus 1 is, for example, empirically measured. A value obtained by subtracting the sum of this maximum value Tup and a margin M from a destruction temperature Ta is set as the first reference temperature TS1.

Specifically, the first reference temperature TS1 is, for example, calculated by the following equation (1).

$$TS1=Ta-(Tup+M) \quad (1)$$

The second reference temperature TS2 is, for example, obtained as follows and set beforehand. That is, a maximum value Tconst of temperature differences between the actual temperatures T1 and the detected temperatures T2 caused by moderate temperature increases resulting from heat generation of the switching elements 120A, 120B during the execution of a normal steady mode of the image forming apparatus 1 is, for example, empirically measured. A value obtained by subtracting the sum of this maximum value Tconst and the margin M from the destruction temperature Ta is set as the second reference temperature TS2.

Specifically, the second reference temperature TS2 is, for example, calculated by the following equation (2).

$$TS2=Ta-(T\mathrm{const}+M) \quad (2)$$

The first and second reference temperatures TS1, TS2 are collectively referred to merely as reference temperatures TS.

Here, the destruction temperature Ta is a temperature at which the switching elements 120A, 120B may be destroyed. When the switching elements 120A, 120B are formed by transistors such as MOSFETs, a temperature predetermined as an absolute maximum rating can be used as the destruction temperature Ta.

The comparator 103 is formed, for example, using an operational amplifier. The contact C of the switch 102 is connected to a non-inverting input terminal (+) of the comparator 103. Accordingly, when the control circuit 100 causes the reference temperature switcher 101 to connect the contacts C and a of the switch 102, the reference voltage V1 is applied to the non-inverting input terminal (+) of the comparator 103. Further, when the control circuit 100 causes the reference temperature switcher 101 to connect the contacts C and b of the switch 102, the reference voltage V2 is applied to the non-inverting input terminal (+) of the comparator 103.

In this way, the control circuit 100 selectively applies the reference voltages V1, V2 to the non-inverting input terminal (+) of the comparator 103. Since the reference voltages V1, V2 respectively correspond to the first and second reference temperatures TS1, TS2, the control circuit 100 can select either one of the first and second reference temperatures TS1, TS2 by switching the switch 102.

The temperature detector 13 is connected to an inverting input terminal (−) of the comparator 103. The voltage Vt output from the temperature detector 13 is applied to the inverting input terminal (−).

The comparator 103 outputs a voltage signal of L (low) level to signal lines L1, L2 via the buffers 104A, 104B when the voltage Vt input to the inverting input terminal (−) becomes equal to or higher than the voltage input to the non-inverting input terminal (+). At this time, the level of a signal input to the gate driver 122 is fixed to L level.

Figure 4:
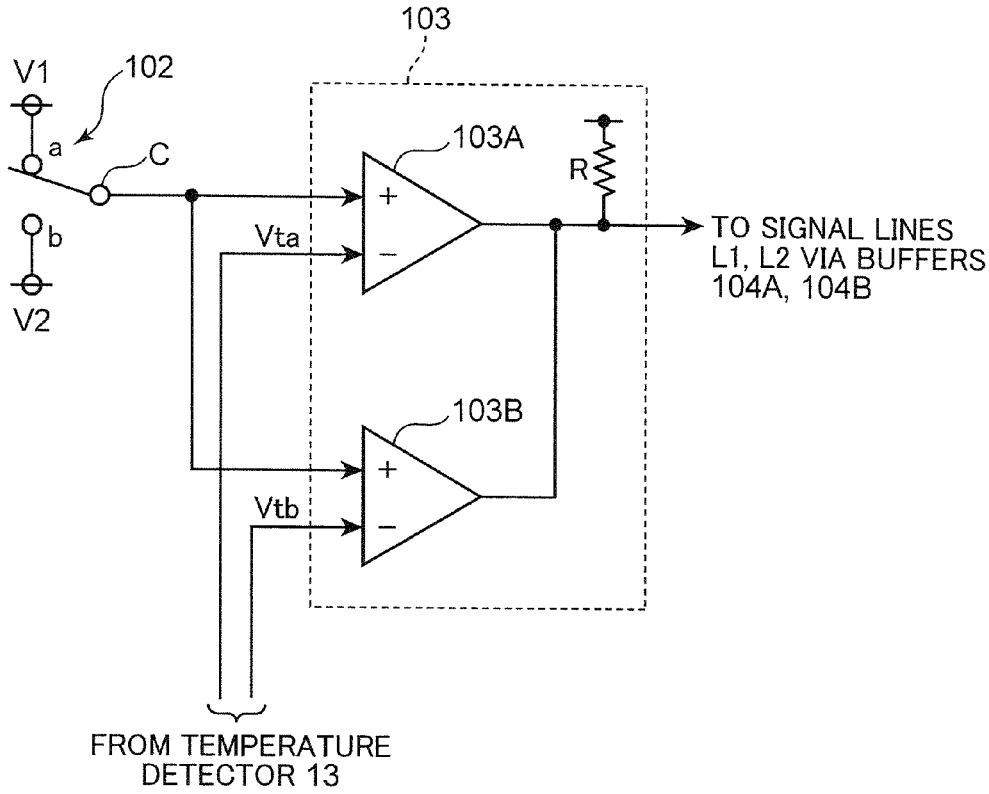
FIG. 4 is a diagram showing a specific arrangement example of a switch and a comparator.

FIG. 4 is a circuit diagram showing a specific arrangement example of the switch 102 and the comparator 103. The comparator 103 shown in FIG. 4 includes comparators 103A, 103B. Further, output signals of the comparators 103A, 103B are pulled up by a resistor R.

In FIG. 4, the comparator 103A is provided in correspondence with the switching element 120A and the comparator 103B is provided in correspondence with the switching element 120B.

The switch 102 is arranged common to the comparators 103A, 103B, and the contact C of the switch 102 is connected to non-inverting input terminals (+) of the comparators 103A, 103B. By this connection, either the reference voltage V1 indicating the first reference temperature TS1 or the reference voltage V2 indicating the second reference temperature TS2 is input to the non-inverting input terminals (+) of the comparators 103A, 103B via the switch 102.

The voltage Vta output from the temperature detector 13 is input to an inverting input terminal (−) of the comparator 103A, and the voltage Vtb output from the temperature detector 13 is input to an inverting input terminal (−) of the comparator 103B.

The comparator 103A outputs a voltage signal of L level to the signal lines L1, L2 via the buffers 104A, 104B when the voltage Vta output from the temperature detector 13 becomes equal to or higher than the reference voltage selected by the switch 102. The comparator 103B outputs a voltage signal of L level to the signal lines L1, L2 via the buffers 104A, 104B when the voltage Vtb output from the temperature detector 13 becomes equal to or higher than the reference voltage selected by the switch 102.

The comparators 103A, 103B have, for example, open drain outputs. Output signals of the comparators 103A, 103B are wired-OR connected using negative logic to become output signals of the comparator 103, which are output to the signal lines L1, L2 via the buffers 104A, 104B. A short circuit of the signal lines L1, L2 is prevented by the buffers 104A, 104B.

For example, the buffers 104A, 104B have, for example, open drain outputs and the signal lines L1, L2 are pulled up by an unillustrated pull-up resistor. By this, the output signals of the comparators 103A, 103B and a pulse output signal of the control circuit 100 are wired-OR connected using negative logic on the signal lines L1, L2.

Accordingly, when at least one of the output signals of the comparators 103A, 103A becomes L level, signal levels of the signal lines L1, L2 are forcibly set to L level.

The reference voltages V1, V2 indicate the first and second reference temperatures TS1, TS2 and the voltage Vta indicates the detected temperature T2A. Accordingly, the comparator 103A forcibly sets the signal levels of the signal lines L1, L2 to L level when the temperature of the switching element 120A detected by the temperature detector 13 becomes equal to or higher than the reference temperature selected by the control circuit 100.

The voltage Vtb indicates the detected temperature T2B. Accordingly, the comparator 103B forcibly sets the signal levels of the signal lines L1, L2 to L level when the temperature of the switching element 120B detected by the temperature detector 13 becomes equal to or higher than the reference temperature selected by the control circuit 100.

Functions of the control circuit 100 are described below. The control circuit 100 has the start-up mode for raising the temperature of the fixing roller 45A from a low-temperature state below the fixing temperature to the fixing temperature and the steady mode for maintaining the temperature of the fixing roller 45A at the fixing temperature.

Here, the steady mode includes a standby mode for waiting for a print job instruction and a printing mode for performing a print job. Further, the fixing temperature is a temperature suitable for fixing a toner image to a recording sheet P.

The control circuit 100 outputs a switching signal instructing connection of the contact C of the switch 102 to the contact a to the reference temperature switcher 101 in the start-up mode. On the other hand, the control circuit 100 outputs a switching signal instructing connection of the contact C of the switch 102 to the contact b to the reference temperature switcher 101 in the steady mode.

Further, the control circuit 100 outputs a pulse signal having a predetermined cycle to the gate driver 122. The pulse signal output from the control circuit 100 is, for example, an open drain output.

Specifically, the control circuit 100 outputs a pulse signal having a predetermined cycle to the switching element 120A via the signal line L1 and the gate driver 122. Further, the control circuit 100 outputs a pulse signal, the phase of which is shifted by 180° from the pulse signal output to the switching element 120A, to the switching element 120B via the signal line L2 and the gate driver 122.

This causes the switching element 120B to be turned off when the switching element 120A is on while causing the switching element 120B to be turned on when the switching element 120A is off.

In this way, the direction of a current flowing into the induction coil 121 is alternately switched between a forward direction (rightward direction in the plane of FIG. 3) and a reverse direction (leftward direction in the plane of FIG. 3), wherefore the direction of the magnetic flux generated by the induction coil 121 successively changes. As a result, an eddy current is generated in the fixing roller 45A and the fixing roller 45A generates heat.

Since the contact C of the switch 102 is connected to the contact a in the start-up mode, the reference voltage V1 is input to the non-inverting input terminals (+) of the comparators 103A, 103B. At this time, when the voltage input to the inverting input terminal (−) of either one of the comparators 103A, 103B becomes equal to or higher than the reference voltage V1, a voltage signal of L level is output to the signal lines L1, L2 from this comparator. As a result, both of the switching elements 120A, 120B are turned off.

On the other hand, since the contact C of the switch 102 is connected to the contact b in the steady mode, the reference voltage V2 is input to the non-inverting input terminals (+) of the comparators 103A, 103B. At this time, when the voltage input to the inverting input terminal (−) of either one of the comparators 103A, 103B becomes equal to or higher than the reference voltage V2, a voltage signal of L level is output to the signal lines L1, L2 from this comparator. As a result, both of the switching elements 120A, 120B are turned off.

The control circuit 100 causes the fixing roller 45A to generate heat so that the temperature of the fixing roller 45A detected by the temperature detector 14 becomes the fixing temperature by outputting pulse signals to the switching elements 120A, 120B after the image forming apparatus 1 is turned on or when a return is made from a sleep mode to a normal mode.

The sleep mode is an operation mode for reducing the temperature of the fixing roller 45A to reduce power consumption more than in the normal mode, for example, such as when the user has not used the image forming apparatus 1 for a long time or when the user performs an operation to set the image forming apparatus 1 in the sleep mode.

Here, a period until the fixing roller 45A reaches the fixing temperature after heat generation of the fixing roller 45A is started after the image forming apparatus 1 is turned on or after the transition is made from the sleep mode to the normal mode corresponds to an example of the start-up mode.

The control circuit 100 controls pulse outputs to the switching elements 120A, 120B so that the temperature of the fixing roller 45A is maintained at the fixing temperature when the temperature of the fixing roller 45A reaches the fixing temperature.

Here, a period during which the temperature of the fixing roller 45A is maintained at the fixing temperature corresponds to an example of the steady mode.

Further, the control circuit 100 selects the first reference temperature TS1 (reference voltage V1) by causing the reference temperature switcher 101 to connect the contact C of the switch 102 to the contact a in the start-up mode. If, for example, the voltage input to the inverting input terminal (−) of the comparator 103A corresponding to the switching element 120A becomes equal to or higher than the reference voltage V1 indicating the first reference temperature TS1 in this state, the comparator 103A outputs a voltage signal of L level to the signal lines L1, L2.

Here, the pulse signal output from the control circuit 100 is forcibly set to L level and both of the switching elements 120A, 120B are turned off if either one of the comparators 103A, 103B outputs the voltage signal of L level.

On the other hand, the control circuit 100 selects the second reference temperature TS2 (reference voltage V2) by causing the reference temperature switcher 101 to connect the contact C of the switch 102 to the contact b in the steady mode. If, for example, the voltage input to the inverting input terminal (−) of the comparator 103A corresponding to the switching element 120A becomes equal to or higher than the reference voltage V2 indicating the second reference temperature TS2 in this state, the comparator 103A outputs a voltage signal of L level to the signal lines L1, L2.

Since the voltage signals of L level are output to the respective switching elements 120A, 120B in this way, the respective switching elements 120A, 120B are turned off. Note that although the switching elements 120A, 120B are turned off in accordance with the voltage signals of L level in this example, they may be turned off in accordance with voltage signals of H level. In this case, the level of a signal output from the comparator 103 is also reversed.

In this example, the reference voltages V1, V2 and the voltage Vt indicate higher temperatures as the voltage increases, but they may indicate lower temperatures as the voltage increases. In this case, the comparator 103 may output a voltage signal of L level when the voltage Vt is equal to or lower than the reference voltage.

The operation of the comparator 103A is mainly described above. Since the comparator 103B operates similar to the comparator 103A, the operation of the comparator 103B is not described.

A relationship between the detected temperatures T2 of the switching elements 120A, 120B detected by the temperature detector 13 and the actual temperatures T1 of the switching elements 120A, 120B is described below.

Figure 5:
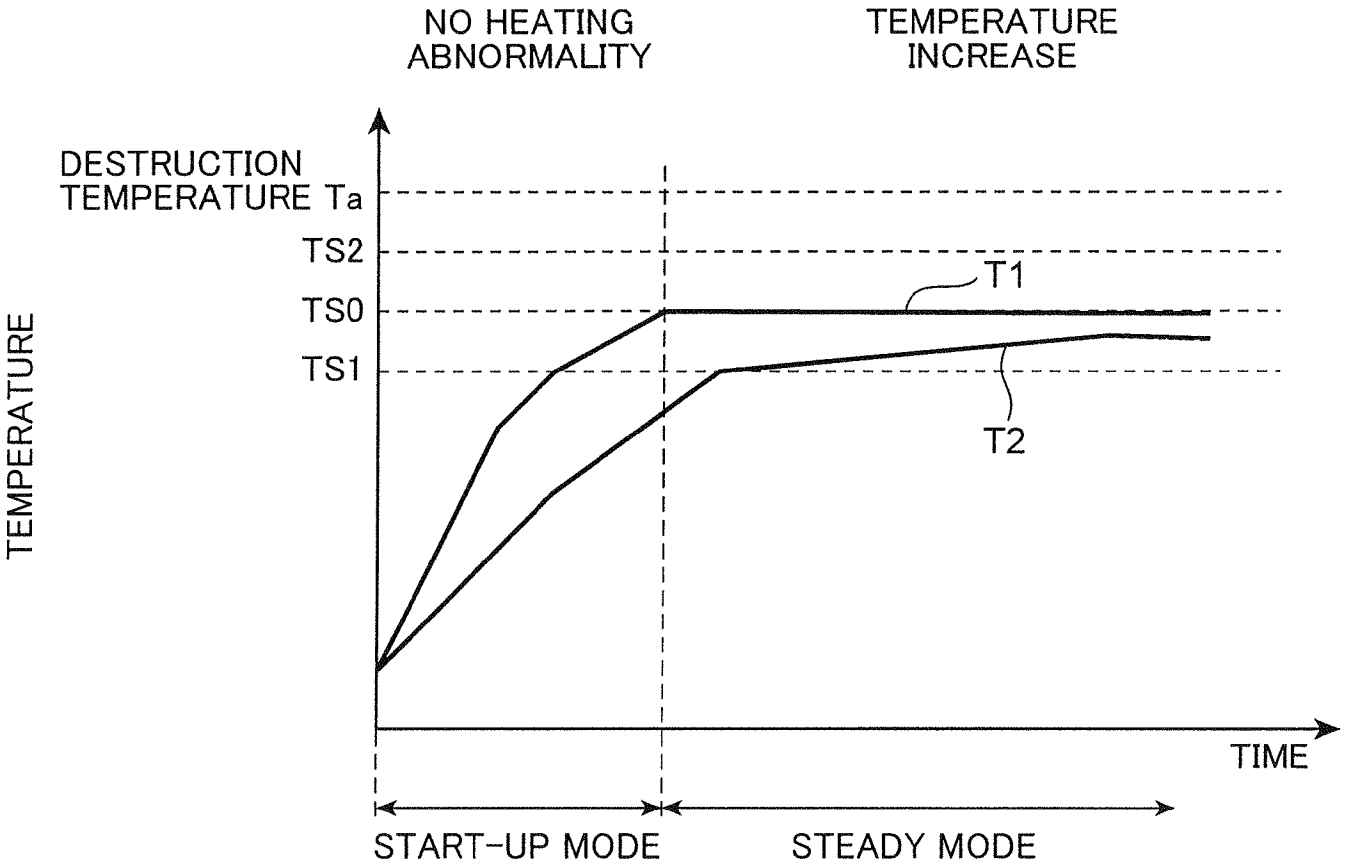
FIG. 5 is a graph showing a relationship between the temperature of a switching element detected by a temperature detector and the actual temperature of the switching element in normal time.

FIG. 5 is a graph showing a relationship between the detected temperatures T2 detected by the temperature detector 13 and the actual temperatures T1 of the switching elements 120A, 120B in normal time.

In the start-up mode, an eddy current flowing in the fixing roller 45A needs to be increased to raise the temperature of the fixing roller 45A from a low temperature to the fixing temperature. Further, the magnetic flux generated by the induction coil 121 to increase the eddy current flowing in the fixing roller 45A needs to be increased. Since the control circuit 100 executes a control to increase currents flowing in the switching elements 120A, 120B for this purpose, the amount of heat generation of the switching elements 120A, 120B increases.

Specifically, the control circuit 100 increases the amount of heat generation of the fixing roller 45A by increasing the pulse frequency of the pulse signals output to the switching elements 120A, 120B to increase a switching frequency after the image forming apparatus 1 is turned on or after a transition is made from the sleep mode to the normal mode.

In this case, when the switching frequency is increased, the amount of heat generation of the switching elements 120A, 120B increases and the actual temperatures T1 of the switching elements 120A, 120B sharply increase.

Then, the temperatures of the switching elements 120A, 120B sharply increase, but the detected temperatures T2 increase later than the actual temperatures T1 of the switching elements 120A, 120B since heat transfer to the temperature detector 13 takes time.

Thus, as shown in FIG. 5, temperature differences between the detected temperatures T2 and the actual temperatures T1 increase in the start-up mode.

On the other hand, in the steady mode, it is sufficient to supply power necessary to maintain the temperature of the fixing roller 45A at the fixing temperature to the induction coil 121, wherefore the amount of heat generation of the switching elements 120A, 120B is less than in the start-up mode.

Thus, as shown in FIG. 5, temperature differences between the detected temperatures T2 and the actual temperatures T1 are less in the steady mode than in the start-up mode.

As shown in FIG. 5, the detected temperatures T2 are below the first reference temperature TS1 in the start-up mode and below the second reference temperature TS2 in the steady mode. In the steady mode, the temperature of the switching element 120 is a steady element temperature TS0 when the temperature of the fixing roller 45A is maintained at the fixing temperature.

Figure 6:
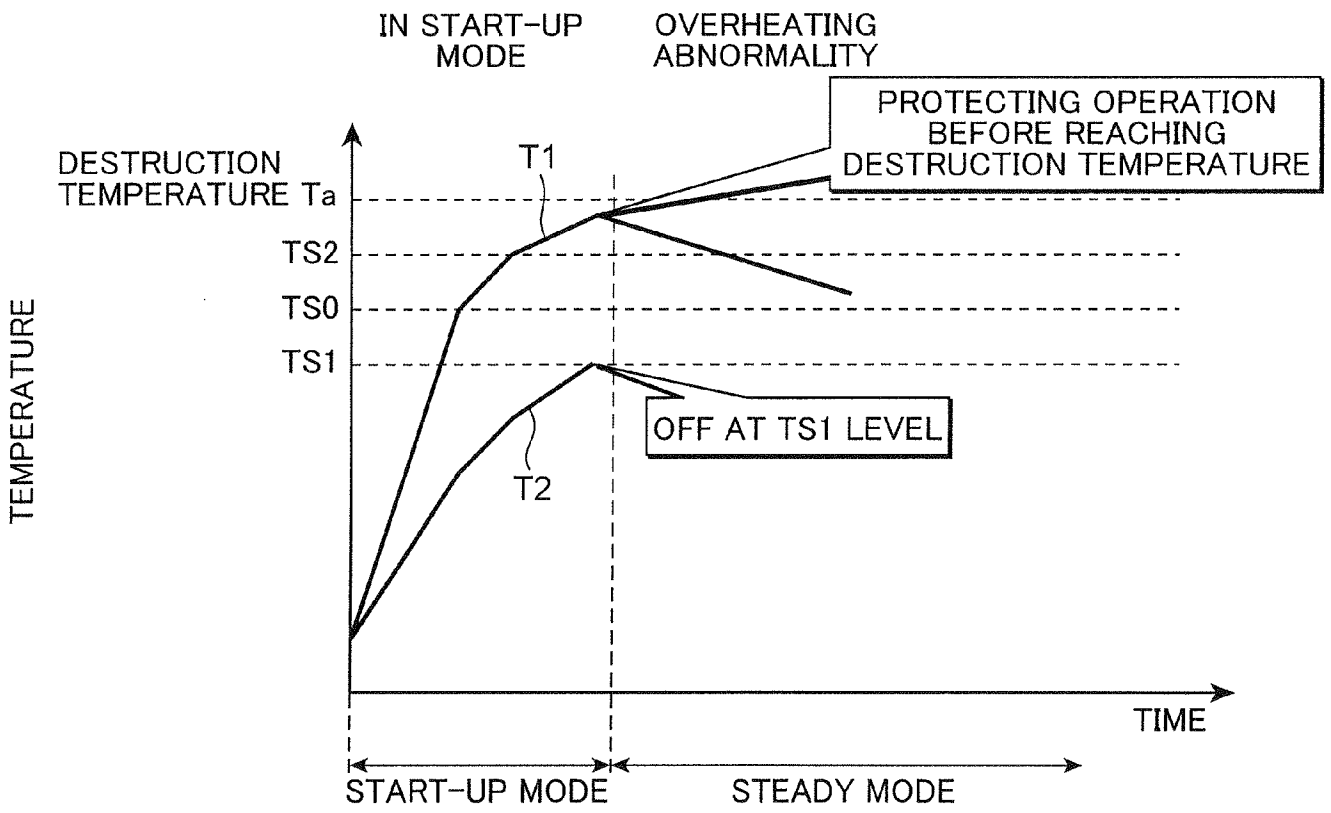
FIG. 6 is a graph showing a relationship between the temperature of the switching element detected by the temperature detector and the actual temperature of the switching element when overheating abnormality occurs in the switching element in a start-up mode.
Figure 7:
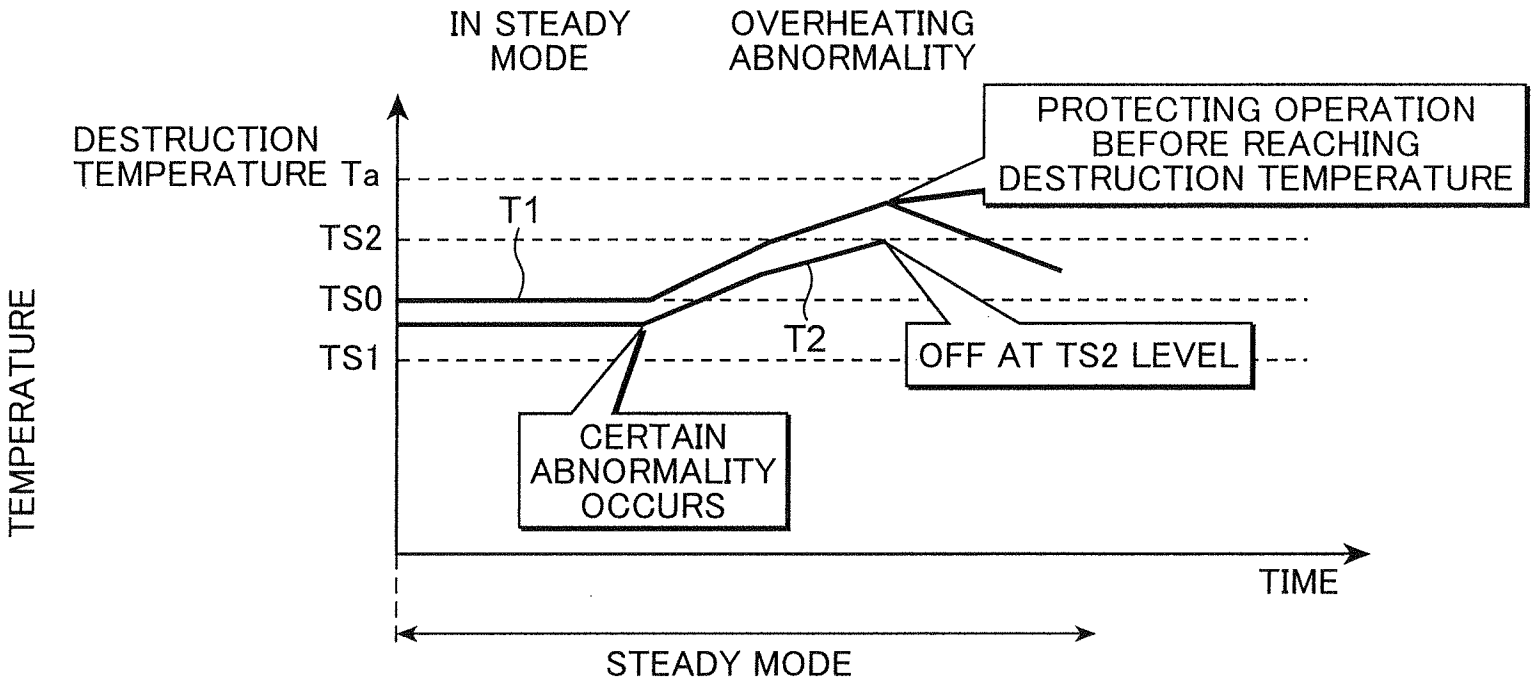
FIG. 7 is a graph showing a relationship between the temperature of the switching element detected by the temperature detector and the actual temperature of the switching element when overheating abnormality occurs in the switching element in a steady mode.

FIG. 6 is a graph showing a relationship between the detected temperatures T2 and the actual temperatures T1 when overheating abnormality of the switching elements 120A, 120B occurs in the start-up mode. FIG. 7 is a graph showing a relationship between the detected temperatures T2 and the actual temperatures T1 when overheating abnormality of the switching elements 120A, 120B occurs in the steady mode.

As shown in FIG. 6, when the switching element 120A is, for example, overheated out of the switching elements 120A, 120B and the actual temperature T1 of the switching element 120A increases to the vicinity of the destruction temperature Ta in the start-up mode, the detected temperature T2 of the switching element 120A follows the actual temperature T1 and approaches the destruction temperature Ta.

When the actual temperature T1 of the switching element 120A reaches a temperature lower than and close to the destruction temperature Ta, the detected temperature T2 of the switching element 120A becomes equal to or higher than the first reference temperature TS1.

Since the first reference temperature TS1 is set as the temperature at which the switching elements 120A, 120B are turned off in the start-up mode as described above, the switching elements 120A, 120B are turned off when the detected temperature T2 becomes equal to or higher than the first reference temperature TS1.

Further, as shown in FIG. 7, when the actual temperature T1 of, e.g. the switching element 120A out of the switching elements 120A, 120B increases to the vicinity of the destruction temperature Ta in the steady mode, the detected temperature T2 of the switching element 120A follows the actual temperature T1 and approaches the destruction temperature Ta higher than the steady element temperature TS0.

When the actual temperature T1 of the switching element 120A reaches a temperature lower than and close to the destruction temperature Ta, the detected temperature T2 becomes equal to or higher than the second reference temperature TS2.

Since the second reference temperature TS2 is set as the temperature at which the switching elements 120A, 120B are turned off in the steady mode as described above, the switching elements 120A, 120B are turned off when the detected temperature T2 becomes equal to or higher than the second reference temperature TS2.

As just described, the switching elements 120A, 120B are turned off when the detected temperature T2 becomes equal to or higher than the first reference temperature TS1 in the start-up mode and turned off when the detected temperature T2 becomes equal to or higher than the second reference temperature TS2 in the steady mode.

In this way, the following effects are achieved. That is, when only the first reference temperature TS1 is set as the reference temperature at which the switching elements 120A, 120B are turned off, the detected temperatures T2 detected by the temperature detector 13 are higher than the first reference temperature TS1 lower than the steady element temperature ISO in the steady mode as shown in FIG. 7. Thus, if being turned off at the reference temperature TS1, the switching elements 120*a*, 120B cannot be driven in the steady mode.

In this case, the switching elements 120A, 120B are unnecessarily turned off even when there is no possibility that the actual temperatures T1 exceed the destruction temperature Ta.

On the other hand, when only the second reference temperature TS2 is set as the reference temperature at which the switching elements 120A, 120B are turned off, the actual temperature T1 of the switching element 120A is already higher than the destruction temperature Ta as is clear from FIG. 6 when the detected temperatures T2 detected by the destruction temperature 13 reach TS2. In this case, the switching element 120A may be destroyed.

Since the fixing device 2 has the above technical features, it can be appropriately prevented that the temperature of the switching element 120A reaches the destruction temperature Ta in both the start-up mode and the steady mode. This prevents the switching element 120A from being unnecessarily turned off and can appropriately protect the switching element 120A from destruction.

The switching element 120A is described in the above description. Since being similar, the switching element 120B is not described.

Figure 8:
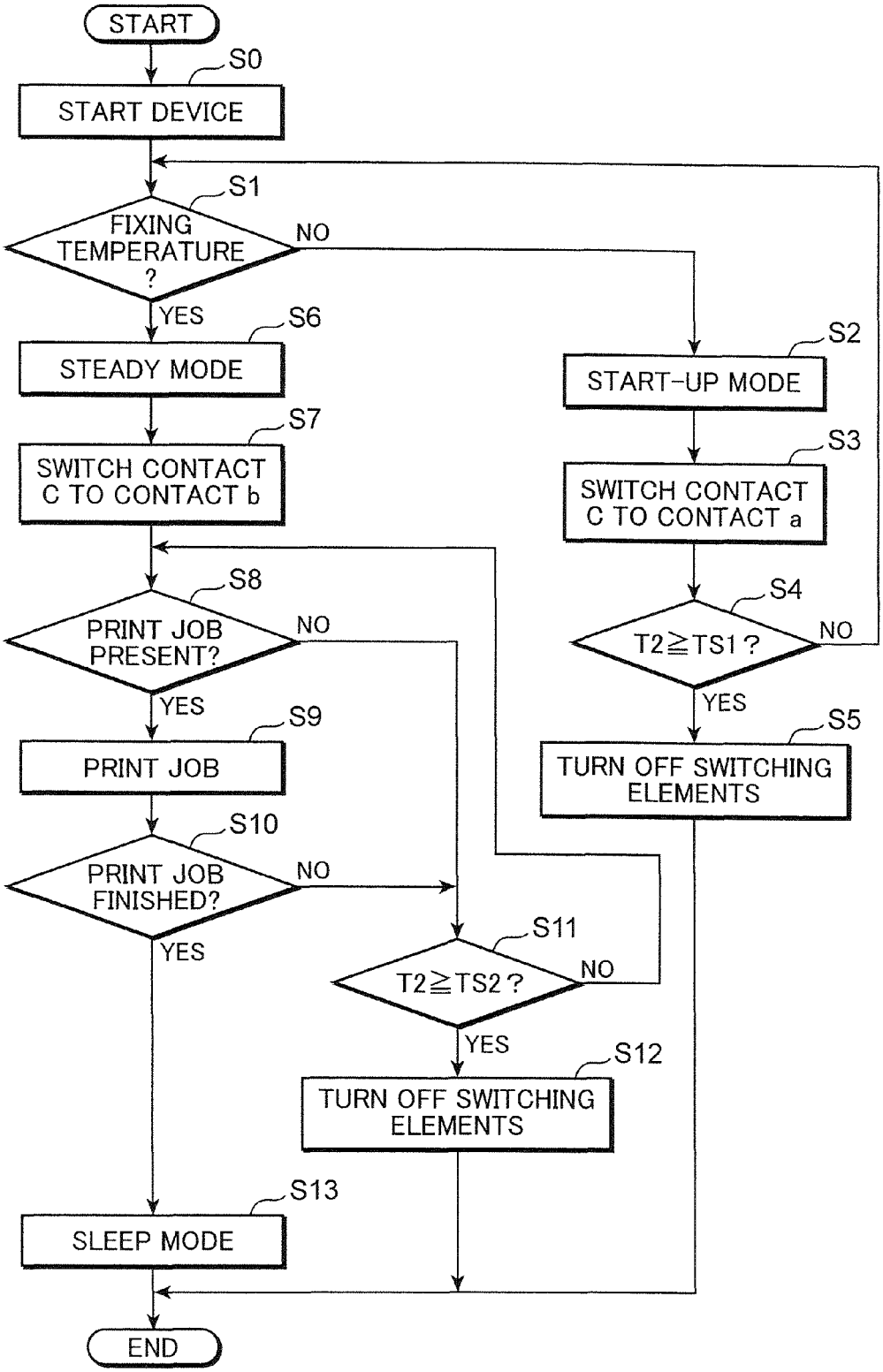
FIG. 8 is a flow chart showing an example of a basic operation of the fixing device.

An example of a process of the fixing device 2 is described below. FIG. 8 is a flow chart showing an example of a basic operation of the fixing device 2.

The control circuit 100 activates the fixing device 2 to start an operation of alternately turning on and off the switching elements 120A, 120B (Step S0) after a return is made from the sleep mode to the normal mode or after the image forming apparatus 1 is turned on. In this way, heat generation of the fixing unit 45 is started.

Subsequently, the control circuit 100 confirms the temperature of the fixing roller 45A detected by the temperature detector 14 (Step S1). If the temperature of the fixing roller 45A is below the fixing temperature (NO in Step S1), the control circuit 100 supplies high-frequency pulse signals to the switching elements 120A, 120B via the signal lines L1, L2 and the gate driver 122 to quickly raise the temperature of the fixing roller 45A as the start-up mode (Step S2).

A period until the temperature of the fixing roller 45A reaches the fixing temperature thereafter, i.e. a period during which Steps S1 to S4 are repeated corresponds to the start-up mode.

In the start-up mode, the fixing roller 45A is quickly heated by the magnetic flux from the induction coil 121, whereby the temperature thereof sharply increases and the actual temperatures T1A, T1B of the switching elements 120A, 120B also sharply increase and the detected temperatures T2A, T2B also increase at a later timing than the actual temperatures T1A, T1B.

Subsequently, the control circuit 100 causes the reference temperature switcher 101 to connect the contact C of the switch 102 to the contact a (Step S3). Then, the first reference temperature TS1 is selected as the reference temperature.

In the start-up mode, the output signal of the comparator 103 is kept in H (high) level when the detected temperatures T2A, T2B of both of the switching elements 120A, 120B are below the first reference temperature TS1 (NO in Step S4). Thus, the output of the pulse signals to the switching elements 120A, 120B by the control circuit 100 is maintained and the control circuit 100 repeats Steps S1 to S4. On the other hand, when the detected temperature T2 of either one of the switching elements 120A, 120B becomes equal to or higher than the first reference temperature TS1 (YES in Step S4), the output signal of the comparator 103 becomes L level, the signal levels of the signal lines L1, L2 are fixed to L level and both of the switching elements 120A, 120B are turned off (Step S5).

The operations in the start-up mode shown in FIGS. 5 and 6 described above are performed by the above Steps S1 to S5.

On the other hand, when the temperature of the fixing roller 45A becomes equal to or higher than the fixing temperature in Step S1 (YES in Step S1), the control circuit 100 transitions to the steady mode to maintain the temperature of the fixing roller 45A at the fixing temperature (Step S6). Then, the control circuit 100 supplies low-frequency pulse signals to the switching elements 120A, 120B via the signal lines L1, L2 and the gate driver 122 for causing heat generation substantially necessary to maintain the temperature of the fixing roller 45A by the magnetic flux from the induction coil 121 in the steady mode.

A period during which the temperature of the fixing roller 45A detected by the temperature detector 14 is maintained at the fixing temperature thereafter is the steady mode (YES in Step S1, Steps S6 to S11). During a period of the steady mode, the control circuit 100 causes the reference temperature switcher 101 to connect the contact C of the switch 102 to the contact b (Step S7).

Thereafter, the control circuit 100 waits until an instruction to perform a print job is received by the user interface unit I (Step S8). Here, a waiting period for the instruction to perform the print job corresponds to the standby mode. Further, a period for performing the print job corresponds to the printing mode. A mode including the standby mode and the printing mode corresponds to the steady mode.

While the instruction to perform the print job is not received by the user interface unit I (NO in Step S8), the output signal of the comparator 103 is kept in H (high) level if the detected temperatures T2A, T2B of both of the switching elements 120A, 120B are below the second reference temperature TS2 (NO in Step S11). Thus, the output of the pulse signals to the switching elements 120A, 120B by the control circuit 100 is maintained and the control circuit 100 repeats Steps S8, S11. On the other hand, when the detected temperature T2 of either one of the switching elements 120A, 120B becomes equal to or higher than the second reference temperature TS2 (YES in Step S11), the output signal of the comparator 103 becomes L level, the signal levels of the signal lines L1, L2 are fixed to L level and both of the switching elements are turned off (Step S12).

The control circuit 100 performs the print job (Step S9) when the instruction to perform the print job is received by the user interface unit I (YES in Step S8). While such a print job is performed (NO in Step S10), the output signal of the comparator 103 is kept in H (high) level if the detected temperatures T2 of both of the switching elements 120A, 120B are below the second reference temperature TS2 (NO in Step S11). Thus, the output of the pulse signals to the switching elements 120A, 120B by the control circuit 100 is maintained and the control circuit 100 repeats Steps S8 to S11. On the other hand, when the detected temperature T2 of either one of the switching elements 120A, 120B becomes equal to or higher than the second reference temperature TS2 (YES in Step S11), the output signal of the comparator 103 becomes L level and the signal levels of the signal lines L1, L2 are fixed to L level and both of the switching elements are turned off (Step S12).

Further, when the print job is finished (YES in Step S10), the control circuit 100 returns to the standby mode. After the image forming apparatus 1 is turned off or after a transition is made from the normal mode to the sleep mode (Step S13), the control circuit 100 stops heat generation of the fixing unit 45 by the drive of the switching elements 120A, 120B.

The operations in the steady mode shown in FIGS. 5 to 7 described above are performed by the above Steps S6 to S12.

As described above, in the start-up mode, the switching elements 120A, 120B are turned off when the detected temperature T2 becomes equal to or higher than the first reference temperature TS1. In the steady mode, the switching elements 120A, 120B are turned off when the detected temperature T2 becomes equal to or higher than the second reference temperature TS2.

In this way, it can be appropriately prevented that the temperatures of the switching elements 120A, 120B reach the destruction temperature Ta in both the start-up mode and the steady mode.

Although the magnetic flux generator 12 adopts an electromagnetic induction heating method for causing heat generation of the fixing roller 45A by changing the direction and magnitude of the magnetic flux generated by the induction coil 121 in this embodiment, the fixing roller 45A may be heated by an electric heater without being limited to this example.

Although both of the switching elements 120A, 120B are turned off in the above example when either one of the detected temperatures T2A, T2B becomes equal to or higher than the reference temperature in the start-up mode, only the switching element whose temperature has become equal to or higher the reference temperature may be turned off. Even in this case, a possibility that the temperature of the switching element 120 exceeds the destruction temperature Ta can be reduced.

However, when both of the switching elements 120A, 120B are turned off when either one of the detected temperatures T2A, T2B becomes equal to or higher than the reference temperature, reliability in keeping the temperature of the switching element 120 below the destruction temperature Ta can be further improved. That is, when the temperature of the switching element becomes equal to or higher than the reference temperature due to a short circuit trouble in the switching element, this switching element cannot be actually turned off even if an attempt is made. Then, when the other switching element is turned on, an overcurrent may flow into the turned-on other switching element to damage this switching element. Even in such a case, damage of the other switching element experiencing no short circuit trouble can be prevented if the both of the switching elements 120A, 120B are turned off when either one of the detected temperatures T2A, T2B becomes equal to or higher than the reference temperature.

Instead of providing the switch 102, the comparator 103 and the buffers 104A, 104B, an analog-to-digital converter for converting the voltages Vt output from the temperature detector 13 into digital values indicating the detected temperatures T2A, T2B may be provided. The control circuit 100 may turn off both of the switching elements 120A, 120B or the switching element whose temperature has become equal to or higher than the reference temperature when either one of the detected temperatures T2A, T2B becomes equal to or higher than the first reference temperature TS1 during the period of the start-up mode and when either one of the detected temperatures T2A, T2B becomes equal to or higher than the second reference temperature TS2 during the period of the steady mode.

However, when the detected temperature T2 becomes equal to or higher than the reference temperature, a response time for protecting the switching elements against a temperature increase can be more easily shortened by turning off the switching elements using the switch 102, the comparator 103 and the buffers 104A, 104B than by turning off the switching elements by a control operation of the control circuit 100 using, for example, a CPU.

In the start-up mode, a current flowing into the switching element to increase the temperature of the fixing unit from a lower temperature to the fixing temperature increases and the amount of heat generation of the switching element increases.

Then, the temperature of the switching element sharply increases, but the temperature detected by the temperature detector increases at a later timing than the temperature increase of the switching element since heat transfer to the temperature detector takes time.

Thus, a temperature difference between the detected temperature of the switching element detected by the temperature detector and the actual temperature of the switching element increases.

On the other hand, the amount of heat generation of the switching element is less in the steady mode than in the start-up mode since not too much power is consumed to maintain the temperature of the fixing unit at the fixing temperature.

Thus, the temperature difference between the detected temperature and the actual temperature is less in the steady mode than in the start-up mode.

According to this construction, the control unit turns off the switching element in the start-up mode when the temperature of the switching element detected by the temperature detector exceeds the first reference temperature lower than the reference temperature in the steady mode. Thus, even if the difference between the detected temperature and the actual temperature increases more than in the steady mode, reliability in turning off the switching element before the actual temperature exceeds the destruction temperature increases.

Further, in the steady mode in which the difference between the detected temperature and the actual temperature is less than in the start-up mode, if the switching element is turned off when the detected temperature exceeds the same first reference temperature as in the start-up mode, the switching element may be turned off even when there is no possibility that the actual temperature exceeds the destruction temperature.

Thus, according to this construction, the control unit does not turn off the switching element in the steady mode until the detected temperature exceeds the second reference temperature higher than the first reference temperature and close to the destruction temperature. Therefore, a possibility that the switching element is unnecessarily turned off and the fixing temperature cannot be maintained is reduced.

Since the control unit turns off the switching element in the steady mode when the detected temperature exceeds the second reference temperature lower than the destruction temperature, reliability in turning off the switching element before the actual temperature exceeds the destruction temperature of the switching element increases.

As a result, overheating of the switching element can be appropriately prevented.

This application is based on Japanese Patent application No. 2010-244541 filed in Japan Patent Office on Oct. 29, 2010, and Japanese Patent application No. 2011-212203 filed in Japan Patent Office on Sep. 28, 2011, contents of which are hereby incorporated by reference.

Although the present invention has been fully described by way of example with reference to the accompanying drawings, it is to be understood that various changes and modifications will be apparent to those skilled in the art. Therefore, unless otherwise such changes and modifications depart from the scope of the present invention hereinafter defined, they should be construed as being included therein.

What is claimed is:

1. A fixing device, comprising:

a fixing unit for fixing a toner image to a recording sheet by heat;

a magnetic flux generator including a switching element for switching a current for generating a magnetic flux to cause heat generation of the fixing unit and adapted to generate a magnetic flux for causing heat generation of the fixing unit;

a temperature detector for detecting the temperature of the switching element; and a control unit for performing a start-up mode for raising the temperature of the fixing unit to a fixing temperature suitable for fixing the toner image to the recording sheet by starting heat generation of the fixing unit by the magnetic flux generated by the magnetic flux generator and a steady mode for controlling heat generation of the fixing unit so that the temperature of the fixing unit is maintained at the fixing temperature after the temperature of the fixing unit reaches the fixing temperature, wherein the control unit:

turns off the switching element when the temperature of the switching element detected by the temperature detector is equal to or higher than a first reference temperature lower than a destruction temperature at which the switching element may be destroyed during a period of the start-up mode, and turns off the switching element when the temperature of the switching element detected by the temperature detector is equal to or higher than a second reference temperature lower than the destruction temperature and higher than the first reference temperature during a period of the steady mode.

2. A fixing device according to claim 1, wherein:

the magnetic flux generator further includes an induction coil for generating a magnetic flux when being energized;

the control unit changes the direction and magnitude of the magnetic flux generated by the induction coil by turning on and off the switching element; and the fixing unit is heated by the flow of an eddy current by changes in the direction and magnitude of the magnetic flux from the induction coil.

3. A fixing device according to claim 1, wherein:

the temperature detector outputs a voltage indicating the temperature of the switching element;

the control unit includes:

a control circuit for turning on and off the switching element by outputting a pulse signal to the switching element, a reference temperature switcher for setting a first reference voltage indicating the first reference temperature as a reference voltage during the period of the start-up mode and setting a second reference voltage indicating the second reference temperature as the reference voltage during the period of the steady mode, and a comparator for comparing the voltage output from the temperature detector and the set reference voltage; and the comparator forcibly fixes the pulse signal to a signal level at which the switching element is turned off when the temperature indicated by the voltage output from the temperature detector is equal to or higher than a temperature indicated by the set reference voltage.

4. A fixing device according to claim 3, further comprising a power supply for supplying the current, wherein:

the magnetic flux generator further includes an induction coil and a resonance capacitor connected in series to the induction coil;

the switching element includes a first switching element and a second switching element;

a series circuit composed of the first and second switching elements is connected between the power supply and ground and a series circuit composed of the induction coil and the resonance capacitor is connected between a connection point between the first and second switching elements and the ground; and the control unit generates two pulse signals having phases different by 180° as the pulse signal, and alternately turns on and off the first and second switching elements such that one is on while the other is off by outputting one pulse signal to the first switching element and the other pulse signal to the second switching element.

5. A fixing device according to claim 4, wherein:

the temperature detector outputs a first voltage indicating the temperature of the first switching element and a second voltage indicating the temperature of the second switching element; and the comparator forcibly fixes the two pulse signals to a signal level at which the first and second switching elements are turned off when the temperature indicated by at least one of the first and second voltages is equal to or higher than the temperature indicated by the set reference voltage.

6. A fixing device according to claim 1, wherein:

a temperature obtained by subtracting the sum of a difference between the actual temperature of the switching element and the temperature detected by the temperature detector during the period of the start-up mode and a predetermined margin from the destruction temperature is set as the first reference temperature; and a temperature obtained by subtracting the sum of a difference between the actual temperature of the switching element and the temperature detected by the temperature detector during the period of the steady mode and a predetermined margin from the destruction temperature is set as the second reference temperature.

7. An image forming apparatus, comprising:

a fixing device according to claim 1;

an image data acquirer for acquiring image data; and an image forming unit for fixing a toner image representing image data acquired by the image data acquirer to a recording sheet by the fixing device.

* * * * *